US011741857B2

(12) United States Patent
Jameson et al.

(10) Patent No.: US 11,741,857 B2
(45) Date of Patent: Aug. 29, 2023

(54) KIT AND METHOD FOR APPLYING A DECORATION ON A SUBSTRATE SUCH AS HUMAN SKIN

(71) Applicant: Spin Master Ltd., Toronto (CA)

(72) Inventors: Mollie B. Jameson, Toronto (CA); Lara Ripley, Toronto (CA); Freda Wise Tam, Toronto (CA); Charles Sink, Friday Harbor, WA (US); Scott Lutz, Toronto (CA)

(73) Assignee: Spin Master Ltd., Toronto (CA)

( * ) Notice: Subject to any disclaimer, the term of this patent is extended or adjusted under 35 U.S.C. 154(b) by 0 days.

(21) Appl. No.: 17/554,959

(22) Filed: Dec. 17, 2021

(65) Prior Publication Data

US 2022/0262276 A1 Aug. 18, 2022

Related U.S. Application Data

(60) Provisional application No. 63/149,657, filed on Feb. 15, 2021.

(51) Int. Cl.
*G09F 3/02* (2006.01)
*B44C 1/10* (2006.01)

(52) U.S. Cl.
CPC ..... *G09F 3/02* (2013.01); *B44C 1/105* (2013.01); *G09F 2003/023* (2013.01)

(58) Field of Classification Search
CPC ..... G09F 3/02; G09F 2003/023; B44C 1/105
See application file for complete search history.

(56) References Cited

U.S. PATENT DOCUMENTS

| | | | |
|---|---|---|---|
| 5,942,065 | A | 8/1999 | Biggs et al. |
| 6,053,178 | A | 4/2000 | Todd |
| 6,264,786 | B1 | 7/2001 | Cromett |
| 6,530,379 | B2 | 3/2003 | Iosilevich |
| 10,264,867 | B2 | 4/2019 | Lawrence |
| 2007/0184094 | A1 | 8/2007 | Williams |

(Continued)

FOREIGN PATENT DOCUMENTS

| | | | |
|---|---|---|---|
| FR | 2959665 | A1 | 11/2011 |
| JP | 2001037511 | A | 2/2001 |

(Continued)

OTHER PUBLICATIONS

English translation of FR2959665A1.

(Continued)

*Primary Examiner* — Laura C Powers
(74) *Attorney, Agent, or Firm* — Aird & McBurney LP

(57) ABSTRACT

In an aspect, a kit for applying a decoration to human skin is provided, and includes a sticker backing sheet with a sticker thereon and a coating backing sheet having a coating thereon. The sticker has first and second faces and adhesives on both faces. A first adhesive force between the first adhesive and human skin is greater than a second adhesive force between the second adhesive and the sticker backing sheet, thereby permitting the sticker to adhere to the skin while peeling off the sticker backing sheet therefrom. The coating is adhered to the coating backing sheet. A third adhesive force between the coating and the sticker is greater than a fourth adhesive force between the coating and the coating backing sheet, so the coating adheres to the sticker while peeling off the coating backing sheet. The coating does not adhere to skin.

6 Claims, 4 Drawing Sheets

(56) References Cited

U.S. PATENT DOCUMENTS

| | | | |
|---|---|---|---|
| 2013/0319443 | A1 | 12/2013 | See |
| 2017/0305100 | A1 | 10/2017 | Tan et al. |
| 2018/0184780 | A1 | 7/2018 | Chevalier |

FOREIGN PATENT DOCUMENTS

| | | | |
|---|---|---|---|
| WO | 2013164521 | A1 | 11/2013 |
| WO | 2015152087 | A1 | 10/2015 |
| WO | 2017001777 | A1 | 1/2017 |
| WO | 2017046877 | A1 | 3/2017 |

OTHER PUBLICATIONS

English translation of WO2015152087A1.
English translation of WO2017001777A1.
English translation of WO2013164521A1.
English translation of JP2001037511A.
English translation of WO2017046877A1.

KIT AND METHOD FOR APPLYING A DECORATION ON A SUBSTRATE SUCH AS HUMAN SKIN

CROSS-REFERENCE TO RELATED APPLICATIONS

This application claims the benefit of U.S. Provisional Patent Application No. 63/149,657, filed Feb. 15, 2021, the contents of which are incorporated herein by reference in their entirety.

FIELD

The specification relates generally to devices and methods for applying a decoration on a substrate.

BACKGROUND OF THE DISCLOSURE

There is a desire by some people (e.g., some children) to apply decals or ornamental patterns or images on their skin. A method exists, as described in U.S. Pat. No. 10,264,867 for applying a tacky layer to a user's nail and then applying decals onto the tacky layer. However, other methods and associated hardware would be beneficial, particularly for application to the skin of the user.

SUMMARY OF THE DISCLOSURE

In an aspect, a kit for applying a decoration to a substrate is provided, and includes a sticker backing sheet with a sticker thereon having a selected shape and a coating backing sheet that has a coating thereon. The sticker has a first face that faces away from the sticker backing sheet and a second face that is adhered to the sticker backing sheet. The first face of the sticker has a first face adhesive thereon and the second face of the sticker has a second face adhesive thereon. A first adhesive force between the first face adhesive and the substrate is greater than a second adhesive force between the second face adhesive and the sticker backing sheet, so as to permit a user to adhere the first face of the sticker to the substrate and to peel off the sticker backing sheet from the second face of the sticker thereafter. A first face of the coating faces away from the coating backing sheet and a second face of the coating is adhered to the coating backing sheet. A third adhesive force between the first face of the coating and the second face adhesive of the sticker is greater than a fourth adhesive force between the second face of the coating and the coating backing sheet, so as to permit the user to adhere the coating to the sticker and to peel off the coating backing sheet from the second face of the coating thereafter. A fifth adhesive force between the first face of the coating is lower than the fourth adhesive force between the second face of the coating and the coating backing sheet, so as to permit the coating to remain adhered to the coating backing sheet when the coating is in contact with a portion of the substrate that is not covered by the sticker. In some embodiments, the substrate may be human skin, such as the skin of the user.

In another aspect, a kit for applying a decoration to human skin is provided, and includes a sticker backing sheet with a sticker thereon having a selected shape and a coating backing sheet that has a coating thereon. The sticker has a first face that faces away from the sticker backing sheet and a second face that is adhered to the sticker backing sheet. The first face of the sticker has a first face adhesive thereon and the second face of the sticker has a second face adhesive thereon. An adhesive force between the first face adhesive and the human skin is sufficiently high to permit a user to adhere the first face of the sticker to the human skin and to peel off the sticker backing sheet from the second face of the sticker thereafter while the first face remains adhered to the human skin. A first face of the coating faces away from the coating backing sheet and a second face of the coating is adhered to the coating backing sheet. An adhesive force between the first face of the coating and the second face adhesive of the sticker is sufficiently high to permit the user to adhere the coating to the sticker and to peel off the coating backing sheet from the second face of the coating thereafter. An adhesive force between the second face of the coating and the coating backing sheet is sufficiently high to permit the coating to remain adhered to the coating backing sheet when the coating is in contact with a portion of the human skin that is not covered by the sticker. In some embodiments, the substrate may be human skin, such as the skin of the user.

In another aspect, a method for applying a decoration to human skin is provided. The method includes applying an adhesive application element, which includes a sticker and a sticker backing sheet, to the human skin; peeling off a backing sheet from the sticker; applying a coating applying application element to the sticker, which includes a coating and a coating backing sheet, and peeling off the coating backing sheet. This leaves the coating on the sticker, and leaves the sticker on the human skin, resulting in a decoration on the human skin.

In another aspect, a method for applying a decoration to a substrate is provided. The method includes applying an adhesive application element, which includes a sticker and a sticker backing sheet, to the substrate; peeling off a backing sheet from the sticker; applying a coating applying application element to the sticker, which includes a coating and a coating backing sheet, and peeling off the coating backing sheet. This leaves the coating on the sticker, and leaves the sticker on the substrate, without leaving the coating directly on the substrate, resulting in a decoration on the substrate.

In some embodiments, the kits and methods described above and elsewhere herein, may be used to apply a decoration to a substrate that is human skin, or to something other than human skin, such as a piece of paper, a notebook cover, a binder cover, or some other suitable substrate.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
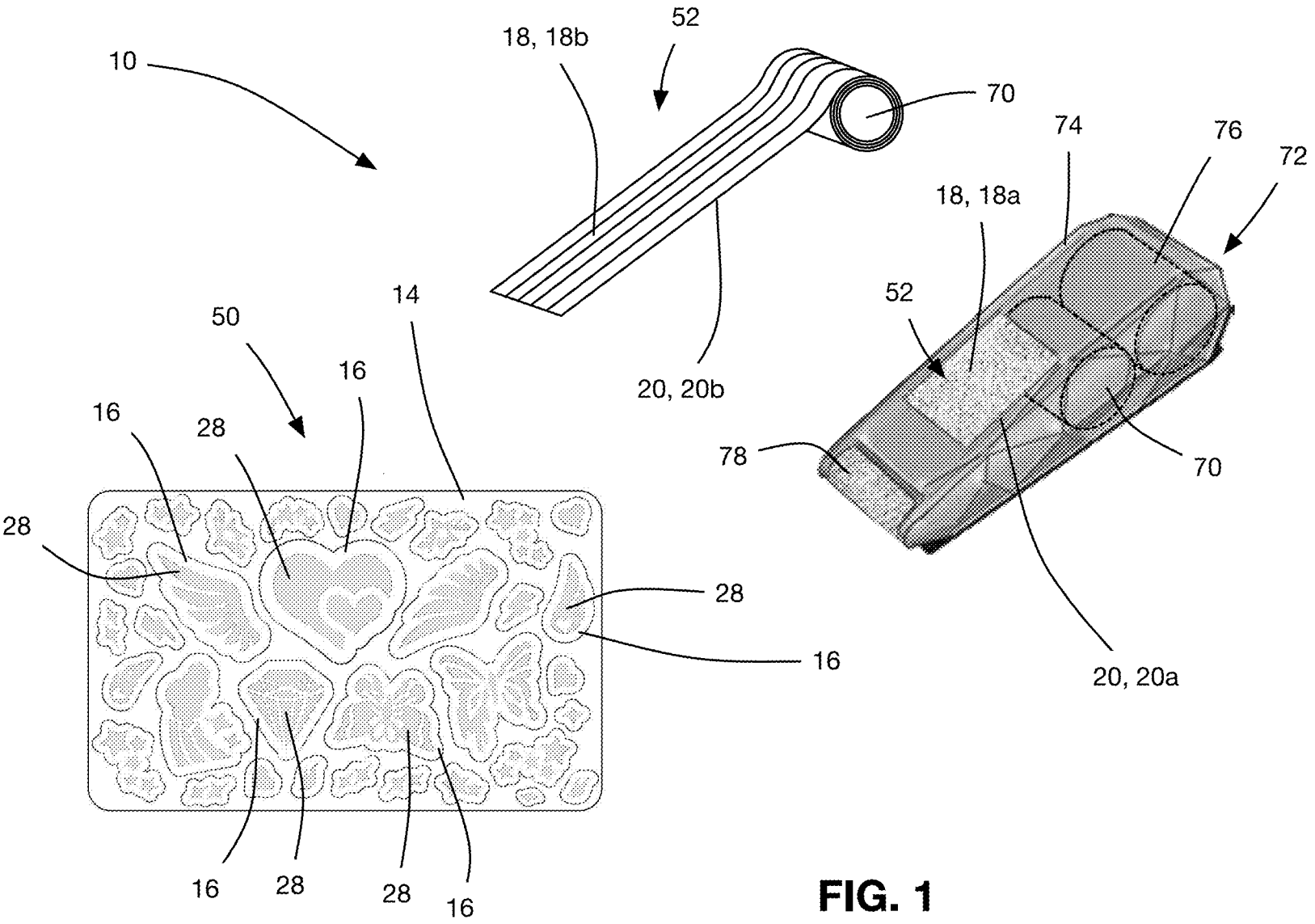
FIG. 1 is a perspective view of a kit for applying a decoration to human skin according to a non-limiting embodiment of the present disclosure, while configured to perform a first maneuver.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Figure 8:
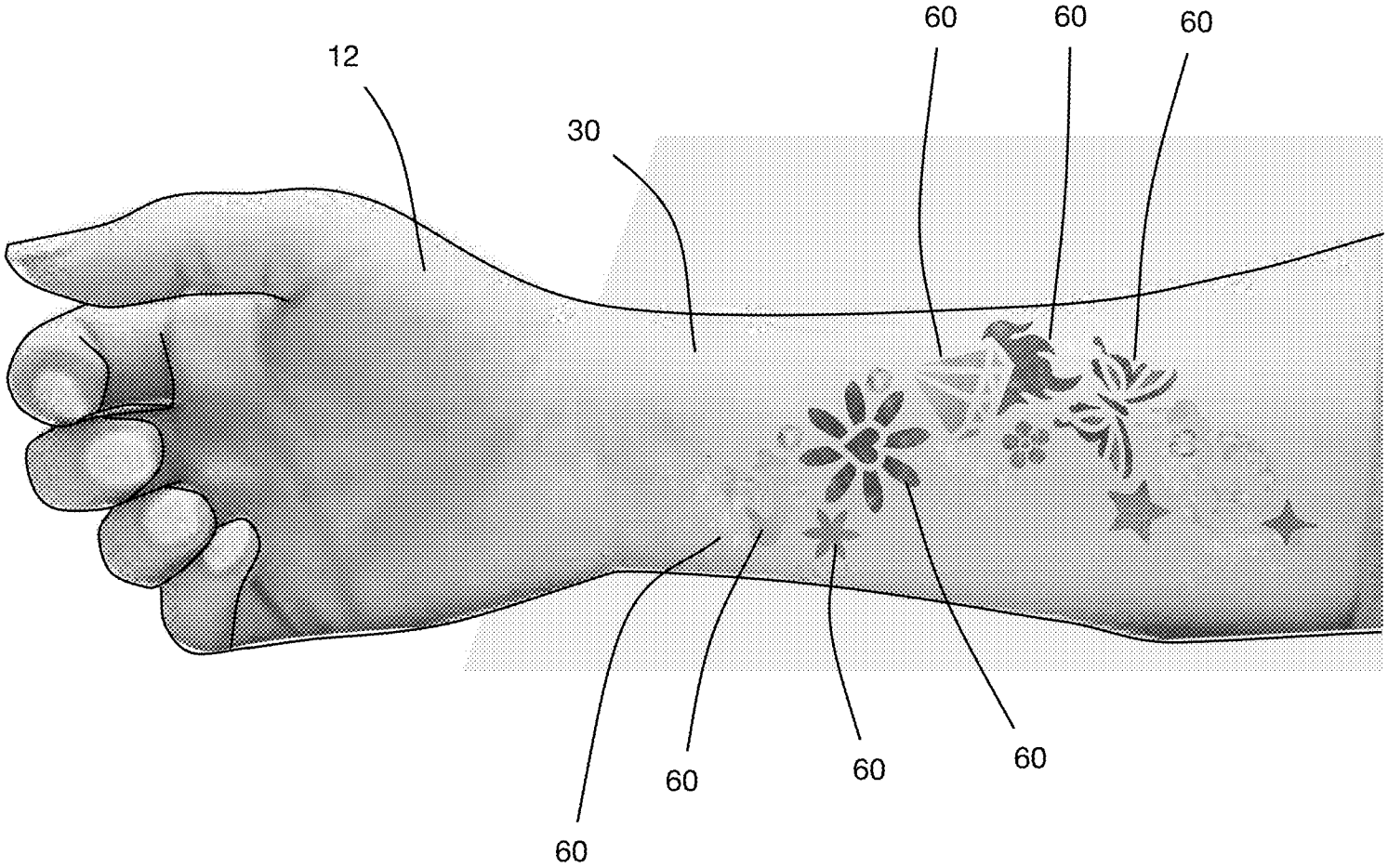
FIG. 8 is a front elevation view of a forearm of a user, illustrating a plurality of decorations thereon.

Reference is made to FIG. 1, which shows a kit 10 for applying body art (also referred to as a decoration shown at 60 in FIG. 8) to a substrate, shown at 12 in FIG. 8. The kit 10 includes a sticker backing sheet 14 with a sticker 16 thereon, and a coating backing sheet 18 that has a coating 20 thereon. In the example embodiment shown, the substrate 12 is human skin, and the description provided below describes the kit 10 and a method of applying a decoration to a substrate, in relation to human skin specifically. However, it will be understood that it is contemplated that the kits and methods described herein may be applied to any other suitable substrate, such as a piece of paper, a notebook cover, a binder cover, a pencil case, a backpack, or some other suitable substrate.

Figure 2:
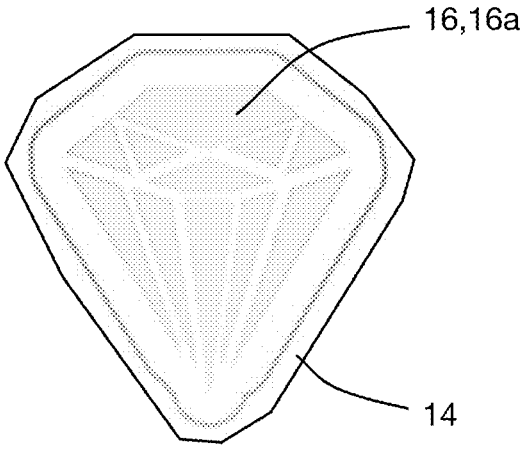
FIG. 2 is a plan view of a sticker shown in FIG. 1.

The sticker backing sheet 14 in the embodiment shown has a plurality of stickers 16 thereon, each of which has a selected shape. Optionally, as shown in FIG. 1, the stickers 16 are all spaced from one another, facilitating the user cutting out a selected sticker 16 that they wish to use. The selected sticker that was cut out is shown at 16*a* in FIG. 2. In an alternative embodiment, the stickers 16 are not spaced apart from one another and are positioned immediately adjacent one another. In yet another embodiment, there is one large sticker 16 on the sticker backing sheet 14, which the user 12 may cut as they wish into individual stickers 16 having any selected shape.

In the embodiment shown there are a plurality of coating backing sheets 18, each having a different coating 20. For example, a first coating backing sheet, shown at 18*a* has a first coating shown at 20*a*, which is speckled in different colours, and a second coating backing sheet, shown at 18*b*, has a second coating shown at 20*b*, which is striped in different colours.

FIGS. 3-7 illustrate a process for decorating the skin (shown at 30) of the user 12. In FIGS. 3-7 it will be noted that the thicknesses of the various elements (e.g., the sticker 16, the coating 20, the first and second backing members 14 and 18, and other elements, such as adhesives) are all shown out of scale and are shown sufficiently thick so as to render the drawings more easily readable by a reader of the present application. It will be understood, that in the production versions of these elements, their thicknesses will be smaller.

Figure 3:
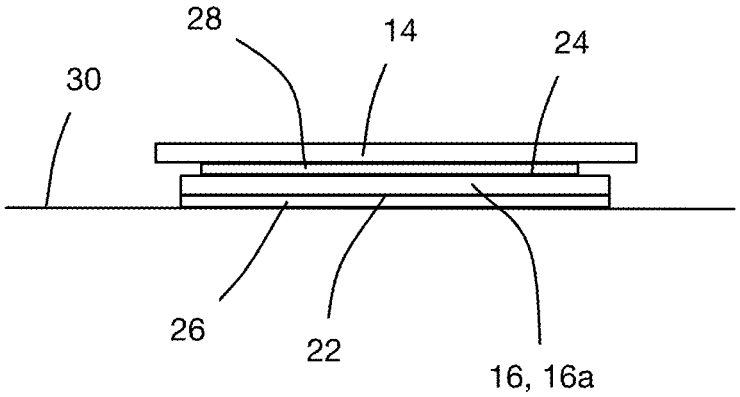
FIG. 3 is a side elevation view of the sticker shown in FIG. 2 being applied to the skin of a user.
Figure 4:
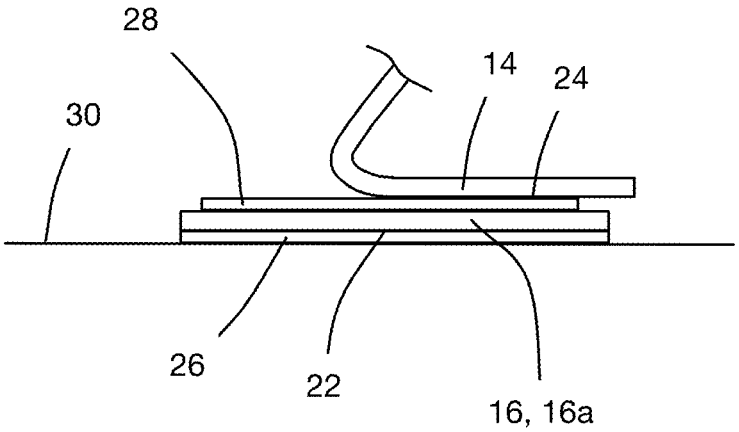
FIG. 4 is a side elevation view of the sticker shown in FIG. 2 while the backing member for the sticker is being peeled off.

As best seen in FIGS. 3 and 4, each sticker 16 has a first face 22 that faces away from the sticker backing sheet 14 and a second face 24 that is adhered to the sticker backing sheet 14. More specifically, the first face 22 of the sticker 16 has a first face adhesive 26 thereon and the second face 24 of the sticker 16 has a second face adhesive 28 thereon. In FIG. 3, the sticker 16 (e.g., the selected sticker 16*a*) is pressed onto the skin 30 of the user 12 (which may be referred to as human skin 30). A first adhesive force F1 between the first face adhesive 26 and the human skin 30 is greater than a second adhesive force F2 between the second face adhesive 28 and the sticker backing sheet 14, so as to permit the user 12 to adhere the first face 22 of the sticker 16 to the human skin 30 and to peel off the sticker backing sheet 14 from the second face 24 of the sticker 16 thereafter (as seen in FIG. 4 in particular). In FIG. 4, it can be seen that the sticker backing sheet 14 is peeled away from the sticker 16, leaving the sticker 16 adhered to the human skin 30.

Worded another way, an adhesive force between the first face adhesive 26 and the human skin 30 (i.e., the user's skin) is sufficiently high to permit the user 12 to adhere the first face 22 of the sticker 16 to the human skin 30 and to peel off the sticker backing sheet 14 from the second face 24 of the sticker 16 thereafter while the first face 22 remains adhered to the human skin 30 (FIG. 4).

Figure 5:
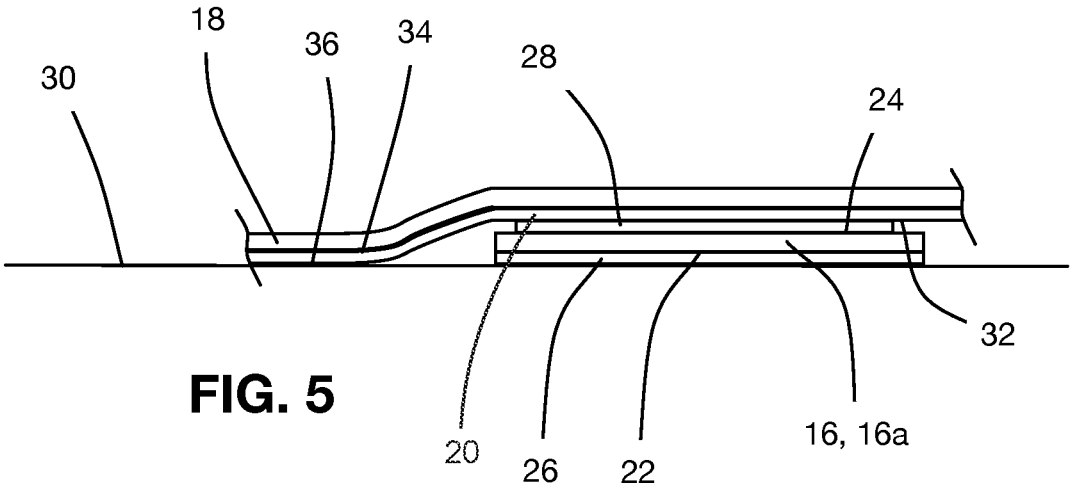
FIG. 5 is a side elevation view of a coating element shown in FIG. 1, being applied to the sticker.
Figure 6:
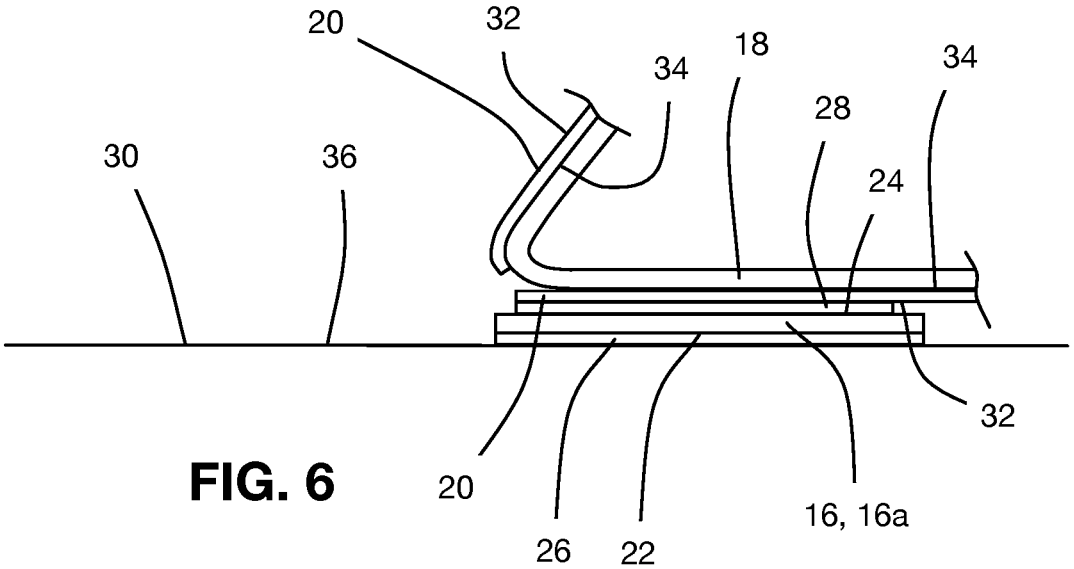
FIG. 6 is a side elevation view of the coating element shown in FIG. 5 having a coating backing member thereon being peeled off.

With reference to FIGS. 5 and 6, a first face 32 of the coating 20 faces away from the coating backing sheet 18 and a second face 34 of the coating 20 is adhered to the coating backing sheet 18. In FIG. 5, the coating 20 (e.g., the coating 20*b*) is pressed onto the skin 30 of the user 12. A third adhesive force F3 between the first face 32 of the coating 20 and the second face adhesive 28 of the sticker 16 is greater than a fourth adhesive force F4 between the second face 34 of the coating 20 and the coating backing sheet 18, so as to permit the user 12 to adhere the coating 20 to the sticker 16 and to peel off the coating backing sheet 18 from the second face 34 of the coating 20 thereafter (as best seen in FIG. 6). In FIG. 6, it can be seen that the coating backing sheet 18 is peeled away from the coating 20, leaving the coating 20 adhered to the sticker 16.

Worded another way, an adhesive force between the first face 22 of the coating 20 and the second face adhesive 28 of the sticker 16 is sufficiently high to permit the user 12 to adhere the coating 20 to the sticker 16 and to peel off the coating backing sheet 18 from the second face 34 of the coating 20 thereafter (FIG. 6).

It will be noted that in FIG. 5, as the user 12 presses the coating 20 onto the sticker 16, some of the coating 20 may also be pressed directly onto the skin 30 of the user 12. However, the coating 20 does not adhere well to the skin of the user 12 and so the coating 20 does not release onto the skin 30 of the user 12 when directly engaged therewith. Worded technically, it may be said that a fifth adhesive force F5 between the first face 32 of the coating 20 is lower than the fourth adhesive force F4 between the second face 34 of the coating 20 and the coating backing sheet 18, so as to permit the coating 20 to remain adhered to the coating backing sheet 18 when the coating 20 is in contact with a portion of the human skin 30 that is not covered by the sticker 16 (e.g. the portion of skin shown at 36). In some embodiments, the fifth adhesive force F5 may be approximately zero (i.e., there may be essentially no stickiness between the coating 20 and human skin (i.e., the skin 30 of the user 12). Worded yet another way, an adhesive force between the second face 34 of the coating 20 and the coating backing sheet 18 is sufficiently high to permit the coating 20 to remain adhered to the coating backing sheet 18 when the coating 20 is in contact with a portion 36 of the skin 30 of the user 12 that is not covered by the sticker 16.

The sticker backing sheet 14 with the stickers 16 thereon may be referred to as an adhesive application element 50, since this is used to apply adhesive (the second face adhesive 28 specifically) onto the skin 30 of the user 12 in such a way as to be ready to receive the coating 20. The coating backing sheet 18 with the coating 20 thereon may be referred to as a coating application element 52, since this is used to apply the coating 20 to the adhesive (i.e., to the second face adhesive 28).

Figure 7:
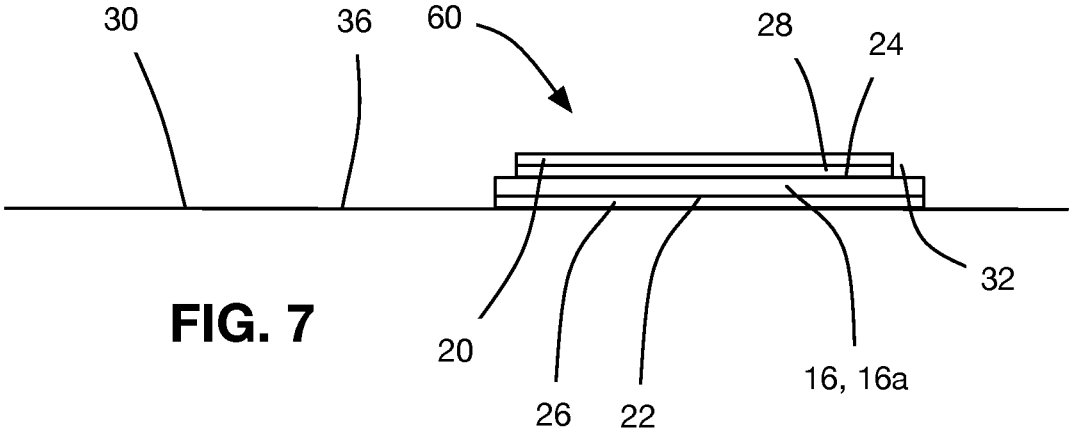
FIG. 7 is a side elevation view of the decoration that is completed after the coating backing member is peeled off.

FIG. 7 shows the final result, which is the sticker 16 adhered to the skin 30 of the user 12, with the coating 20 thereon. The sticker 16 with the coating 20 thereon may be referred to as body art 60, or equivalently, as a decoration 60. Thus, the kit 10 may be said to be usable to make a decoration 60 on the skin 30 of the user 12.

FIG. 8 shows the user 12 (in particular the forearm of the user 12) with some example decorations 60 thereon.

Any suitable material may be used for the stickers 16, the first and coating backing sheets 14 and 18 and the first and second face adhesives 26 and 28, ensuring that the materials used are safe for contact with human skin.

The relative strengths of the adhesive forces F1, F2, F3, F4 and F5 have been described. Specific example values are not necessary to be given. It would be within the skill of a person skilled in the art to be able to arrive at suitable values, that permit the user 12 to apply a decoration 60 to themselves and to eventually remove the decoration 60 when desired. Other relative strengths, that have not been described herein, are not important. For example, it is not important whether the first adhesive force F1 is greater than, less than, or identical to, either of the third adhesive force F3 or the fourth force F4. It is similarly not important whether the second adhesive force F2 is greater than, less than, or identical to, either of the third adhesive force F3, or the fourth adhesive force F4.

In some embodiments the sticker 16 may be generally transparent. In some further embodiments, the sticker 16 may be tinted relatively lightly where the second face adhesive 28 is present so as to help the user 12 to know where to place the coating 20 on their skin 30. In the embodiments shown, the sticker 16 may be tinted in a transparent blue colour, so as to be different from, and therefore to easily be distinguished from, the colour of the skin 30 of the user 12, while not affecting the visual appearance of the coating 20 once the coating 20 is applied thereon.

It will be noted that the coating application element 52 that includes the first coating backing member 18*a* and the first coating 20*a* is shown as being mounted on a coating spool 70, which is provided in an applicator shown at 72. The applicator 72 may include a housing 74, a take up spool 76 and the aforementioned coating spool 70. The housing 74 has a window 78 therein. As the user 12 slides the applicator along a sticker 16, the adhesive force between the second face adhesive 28 and the coating 20 (i.e., the first adhesive force F3) causes the coating element 52 to feed, which causes rotation of the coating spool 70. The coating spool 70 may be operatively connected (e.g., via gears or some other suitable power transmission structure) to the take up spool 76 so as to drive rotation thereof, so as to take up the consumed coating element 52. Alternatively, the coating element 52 need not be provided in an applicator 72. As can be seen, the coating element 52 that includes the second coating backing sheet 18*b* and the second coating 20*b*, is provided on a coating spool 70, without an applicator. In yet another embodiment, the coating element 52 may be provided as a strip without being provided on a coating spool.

An advantage of at least some embodiments of the kits and methods described herein is that they permit the user 12 to apply a decoration to a substrate where the user 12 is able to choose both the shape of the decoration, and the colouring of the decoration independently of one another.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A kit for applying a decoration to human skin, comprising:

a sticker backing sheet with a sticker thereon having a selected shape that is a smaller size than the sticker backing sheet, wherein the sticker has a first face that faces away from the sticker backing sheet and a second face that is adhered to the sticker backing sheet, wherein the first face of the sticker has a first face adhesive thereon and the second face of the sticker has a second face adhesive thereon, wherein a first adhesive force between the first face adhesive and the human skin is greater than a second adhesive force between the second face adhesive and the sticker backing sheet, so as to permit a user to adhere the first face of the sticker to the human skin and to peel off the sticker backing sheet from the second face of the sticker thereafter; and a coating backing sheet that has a coating thereon, wherein a first face of the coating faces away from the coating backing sheet and a second face of the coating is adhered to the coating backing sheet, wherein a third adhesive force between the first face of the coating and the second face adhesive of the sticker is greater than a fourth adhesive force between the second face of the coating and the coating backing sheet, so as to permit the user to adhere the coating to the sticker and to peel off the coating backing sheet from the second face of the coating thereafter, and wherein a fifth adhesive force between the first face of the coating and human skin is lower than the fourth adhesive force between the second face of the coating and the coating backing sheet, so as to permit the coating to remain adhered to the coating backing sheet when the coating is in contact with a portion of the human skin that is not covered by the sticker.

2. A kit as claimed in claim 1, wherein the sticker is transparent.

3. A kit as claimed in claim 2, wherein the sticker is tinted in a colour that is different than that of the human skin.

4. A kit for applying a decoration to human skin, comprising:

a sticker backing sheet with a sticker thereon having a selected shape that is a smaller size than the sticker backing sheet, wherein the sticker has a first face that faces away from the sticker backing sheet and a second face that is adhered to the sticker backing sheet, wherein the first face of the sticker has a first face adhesive thereon and the second face of the sticker has a second face adhesive thereon, wherein an adhesive force between the first face adhesive and the human skin permits a user to adhere the first face of the sticker to the human skin and to peel off the sticker backing sheet from the second face of the sticker thereafter while the first face remains adhered to the human skin; and a coating backing sheet that has a coating thereon, wherein a first face of the coating faces away from the coating backing sheet and a second face of the coating is adhered to the coating backing sheet, wherein an adhesive force between the first face of the coating and the second face adhesive of the sticker permits the user to adhere the coating to the sticker and to peel off the coating backing sheet from the second face of the coating thereafter, and wherein an adhesive force between the second face of the coating and the coating backing sheet permits the coating to remain adhered to the coating backing sheet when the coating is in contact with a portion of the human skin that is not covered by the sticker.

5. A kit as claimed in claim 4, wherein the sticker is transparent.

6. A kit as claimed in claim 5, wherein the sticker is tinted in a colour that is different than that of the human skin.

* * * * *